US005651323A

United States Patent [19]

Hirose et al.

[11] Patent Number: 5,651,323

[45] Date of Patent: Jul. 29, 1997

[54] HOOK ASSEMBLY WITH COATED SURFACES FOR SEWING MACHINE

[75] Inventors: Tokuzo Hirose; Kiyoshi Nakamura, both of Osaka, Japan

[73] Assignee: Hirose Manufacturing Co., Ltd., Osaka, Japan

[21] Appl. No.: 390,481

[22] Filed: Feb. 17, 1995

[30] Foreign Application Priority Data

| | | | |
|---|---|---|---|
| Feb. 24, 1994 | [JP] | Japan | 6-026985 |
| Oct. 12, 1994 | [JP] | Japan | 6-246591 |
| Oct. 12, 1994 | [JP] | Japan | 6-246592 |

[51] Int. Cl.[6] ..... D05B 57/16

[52] U.S. Cl. ..... 112/231; 112/256

[58] Field of Search ..... 112/231, 230, 112/228, 181, 184; 524/600

[56] References Cited

U.S. PATENT DOCUMENTS

| | | | |
|---|---|---|---|
| 2,348,718 | 5/1944 | Bethune | 112/196 |
| 2,822,773 | 2/1958 | Ivanko | 112/232 |
| 2,851,978 | 9/1958 | Eriksson | 112/232 |
| 3,016,033 | 1/1962 | Herbst | 112/232 |
| 3,347,193 | 10/1967 | Perri | 112/231 X |
| 4,393,798 | 7/1983 | Cheng | 112/231 |
| 4,660,487 | 4/1987 | Mikuni | 112/230 |
| 5,076,182 | 12/1991 | Hirose et al. | 112/230 X |
| 5,109,783 | 5/1992 | Shimizu | 112/231 |
| 5,312,866 | 5/1994 | Tsutsumi et al. | 524/600 |
| 5,413,058 | 5/1995 | Hirose et al. | 112/231 |

FOREIGN PATENT DOCUMENTS

| | | | |
|---|---|---|---|
| 1116991 | 5/1956 | France . | |
| 1148397 | 12/1957 | France | 112/232 |
| 67797 | 3/1958 | France . | |
| 49-3761 | 4/1972 | Japan . | |
| 63-262180 | 10/1988 | Japan . | |
| 2-9077 | 2/1990 | Japan . | |
| 4-345667 | 12/1992 | Japan . | |
| 2-122676 | 1/1994 | Japan . | |
| 6031084 | 2/1994 | Japan | 112/231 |
| 6-170075 | 6/1994 | Japan . | |
| 6-238084 | 8/1994 | Japan . | |
| 728247 | 4/1955 | United Kingdom | 112/231 |
| 766952 | 1/1957 | United Kingdom . | |
| 779561 | 7/1957 | United Kingdom . | |

*Primary Examiner*—Ismael Izaguirre
*Attorney, Agent, or Firm*—Wenderoth, Lind & Ponack

[57] ABSTRACT

A hook assembly includes a bearing rib on a bobbin case basket or at least a surface layer thereof composed of a synthetic resin, such as a liquid crystal polymer, which has properties such that the amount of the rotating friction generated between such surface layer and an inner surface layer of a groove shaped bearing raceway in which the bearing rib is fitted is lower, with no industrial sewing machine oil therebetween than such industrial sewing machine oil where to be provided therebetween. The hook assembly thus has good durability without any lubrication being provided. Accordingly, oil staining of threads and sewing materials by a lubricant is avoided, and sewing quality is enhanced.

11 Claims, 18 Drawing Sheets

HOOK ASSEMBLY WITH COATED SURFACES FOR SEWING MACHINE

BACKGROUND OF THE INVENTION

1. Field of the Invention

The present invention relates to a hook assembly which is incorporated into a lockstitch sewing machine or the like as well as to a sewing process utilizing such hook assembly.

2. Description of the Related Art

A bobbin case basket assembly which is incorporated into a lockstitch sewing machine has a bearing rib formed on its outside circumference, which bearing rib is fitted into a groove shaped bearing raceway formed in the inside circumference of a hook. The hook is rotated at a high speed while the bobbin case basket assembly is prevented from rotating downstream in the direction of rotation of the hook by a position finger secured to the body of the sewing machine. Specifically, hooks of industrial sewing machines are rotated at high speeds of about 6,000–10,000 rpm.

Accordingly, a large frictional force is generated due to the sliding contact between the bearing rib and the groove shaped bearing raceway. In cases where the friction between the bearing rib and the groove shaped bearing raceway is high, the position finger is brought into vigorous contact with the side wall of a rotation restraining groove of the bobbin case basket assembly. Therefore a needle thread cannot pass smoothly through the rotation restraining groove. This causes the tension of the needle thread to change undesirably and the sewing quality to worsen. Durability is also diminished due to the friction between the bearing rib and the groove shaped bearing raceway.

In order to solve this problem, there is a well known construction designed to provide a lubricant between the surface layer, or the outside circumference, of the bearing rib on the bobbin case basket assembly and the inside circumference of the groove shaped bearing raceway in the hook. This construction, however, has the disadvantage that the needle thread, bobbin thread, cloth, etc., become stained by the lubricant. Accordingly, another conventional construction includes coating of the bearing rib on the bobbin case basket assembly with a fluorine resin with a low friction coefficient, such as TEFLON (trade name). According to the techniques of such prior art arrangement, however, since the fluorine resin is sprayed and baked to provide a thin film coating usually around 10–20 μm thick, the durability thereof is poor, and particularly in cases where no oil is fed, there is an additional problem that such coating readily peels off.

SUMMARY OF THE INVENTION

An object of the present invention is to provide a, hook assembly, wherein the friction of the rotating section is minimized without lubrication, so that the hook assembly can rotate smoothly and stably at a high speed.

The present invention relates to a hook assembly for a sewing machine and including a bearing rib formed on the outside circumference of a bobbin case basket and extending circumferentially and a groove shaped bearing raceway for rotating the bobbin case basket, which surrounds the bobbin case basket, extends circumferentially, and fits the bearing rib. At least either the bearing rib or at least its surface layer, or the groove shaped bearing raceway or at least its inside circumference layer is composed of a synthetic resin of such type that the rotating frictional force of sliding contact between the surface layer of the bearing rib and the inside circumference layer of the groove shaped bearing raceway into which the bearing rib is fitted is lower in cases where no industrial sewing machine oil is present between such surface layer and such inside circumference layer than in other cases with the industrial sewing machine oil present therebetween.

The present invention further relates to a hook assembly for a sewing machine wherein the hook assembly is a rotary hook assembly, and the hook is a rotary hook.

The present invention further relates to a hook assembly for a sewing machine wherein the hook assembly is an oscillating shuttle hook assembly, and the shuttle hook is an oscillating loop taker.

The present invention further relates to a hook assembly for a sewing machine wherein the synthetic resin is a liquid crystal polymer.

The present invention further relates to a hook assembly for a sewing machine, characterized in that the synthetic resin is an aromatic polyamide resin.

The present invention further relates to a hook assembly for a sewing machine wherein the bobbin case basket comprises a cylindrical section for receiving the bobbin, and the bearing rib is an endless ring fittedly secured to the outside circumference of the cylindrical section.

The present invention further relates to a bobbin case basket assembly for a sewing machine wherein that the bearing rib section of a metal bobbin case basket assembly body comprises a bearing rib formed integrally with a synthetic resin coating member which covers from a loop-spreading section to a rail end section of the bearing rib section, with the coating member being stripped off and not covering the loop-spreading section of the metal bearing rib section upwardly in the direction of rotation of the hook.

The present invention further relates to a sewing process using the above hook assembly for a sewing machine which is rotated or oscillated, wherein at least either the bearing rib or at least its surface layer, or the groove shaped bearing raceway or at least its inside circumference layer is composed of a synthetic resin of such type that a rotating frictional force of a slide contact portion between the surface layer of the bearing rib and the inside circumference layer of the groove shaped bearing raceway into which the bearing rib is fitted is lower in cases where no industrial sewing machine oil is present between such surface layer and such inside circumference layer than in other cases with the industrial sewing machine oil present therebetween, and sewing is performed without hook lubrication.

According to the present invention, the bearing rib and/or the groove shaped bearing raceway in the hook assembly or at least its surface layer is composed of a synthetic resin, such as a liquid crystal polymer, which has such properties that the rotating frictional force of a sliding contact portions between the surface layer of the bearing rib and the inside circumference layer of the groove shaped bearing raceway into which the bearing rib is fitted is lower in cases where no industrial sewing machine oil is present between such surface layer and such inside circumference layer than in other cases with the industrial sewing machine oil present therebetween. Accordingly, a sewing machine incorporating such hook assembly can be operated without hook lubrication. Because of the low friction between the bearing rib and the groove shaped bearing raceway, frictional heat is negligible and does not cause burning. Thus, staining of needle thread, bobbin thread, sewing material, etc., by hook lubricants may be prevented.

In addition, since the rotating frictional force between the bearing rib and the groove shaped raceway in the hook assembly is minimized, a force applied to a bobbin case assembly retaining portion also is diminished. Therefore, a loop of needle thread smoothly passes through the retaining portion without exerting great tension on the loop of needle thread. This can improve sewing quality.

Further, by using a liquid crystal polymer or aromatic polyimide resin according to the present invention, the friction between the surface layer of the bearing rib and the inside circumference of the groove shaped bearing raceway can be reduced. Thereby, durability of the hook rotating portion is improved compared with the cases where teflon or other types of resin are used.

The oil-free type hook assembly according to the present invention consumes no lubricant such as industrial sewing machine oil. As a result, a structure for feeding a lubricant is not required, which allows not only simpler a construction but also easier maintenance of the machine.

The present invention also may be applied to horizontal rotary hook assemblies, vertical rotary hook assemblies, oscillating shuttle hook assemblies, etc.

According to the present invention, the bearing rib section of the metal bobbin case basket body comprises a bearing rib formed integrally with a synthetic resin coating member, for example, from the loop-spreading section to the rail end section. The coating member and the bearing rib section may be formed into one piece by exertion of great force so that the coating member does not easily peel off from the bearing rib section. The friction between the bearing rib on the bobbin case basket and the groove shaped bearing raceway in the hook may be minimized. Therefore, the hook assembly can be rotated in a smooth and stable manner at a high speed. This eliminates the need for hook lubrication, thereby preventing staining of the thread, cloth, etc. by lubricants. Further, since in the loop-spreading section with which the thread is in sliding contact, the coating member is stripped from the metal bearing rib section upstream in the direction of rotation of the hook, the formation of "thread print" is prevented.

Also according to the present invention, since the coating member is formed of a synthetic resin such as a liquid crystal polymer, aromatic polyimide resin or the like, productivity may be increased because of ease of processing.

Also according to the present invention, the hook may comprise a main hook body and a slide member. The slide member may be composed of a synthetic resin having a low friction coefficient, and may be formed integrally with the hook body by, for example, insert or outsert molding. Into the groove shaped bearing raceway wherein the slide member is formed in this manner is fitted the bearing rib on the bobbin case basket. This lessens the frictional force of the bearing rib and groove shaped bearing raceway, and therefore, the hook assembly can be rotated stably at a high speed.

BRIEF DESCRIPTION OF THE DRAWINGS

Other and further objects, features, and advantages of the invention will be more apparent from the following detailed description taken with reference to the drawings wherein.

DETAILED DESCRIPTION OF PREFERRED EMBODIMENTS

Figure 1:
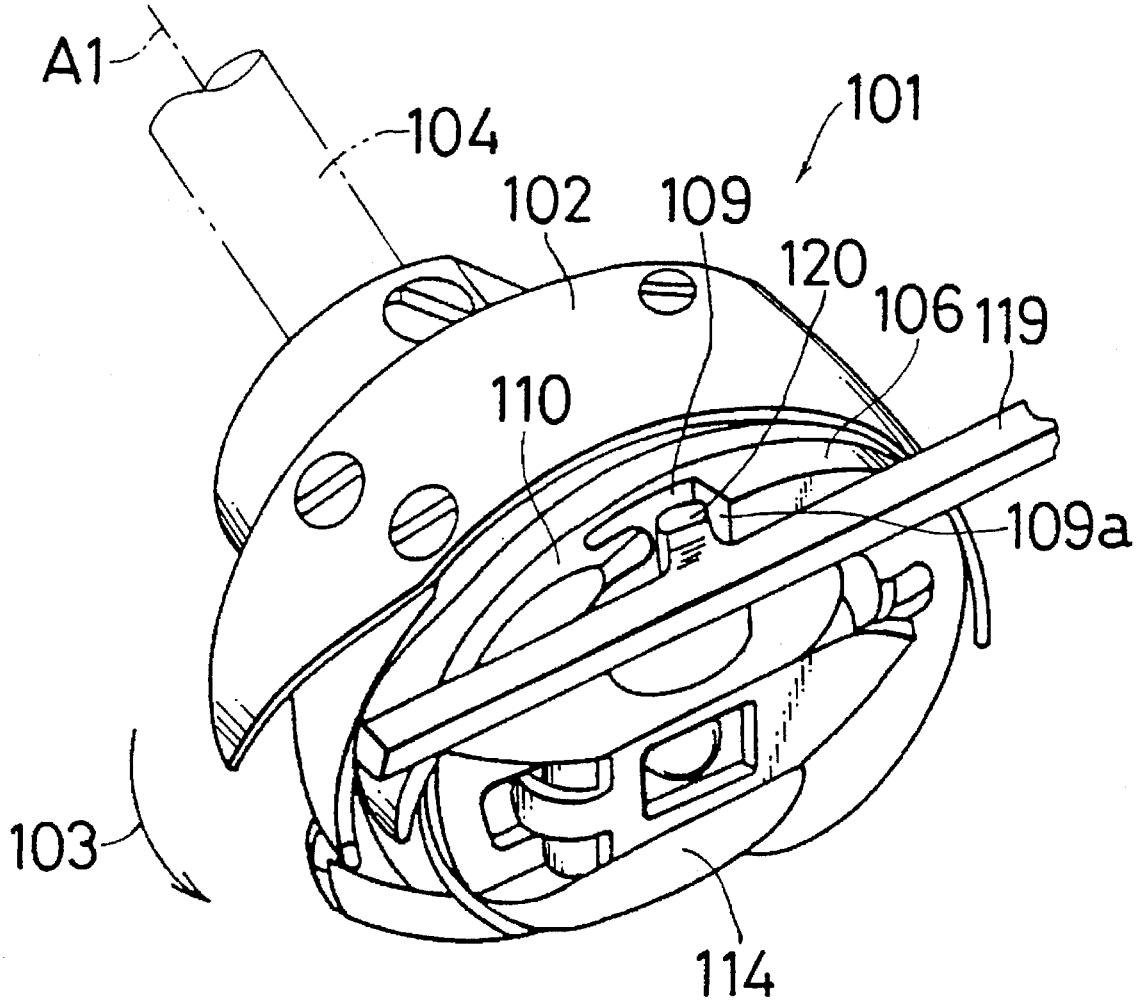
FIG. 1 is a perspective, view of a vertical rotary hook assembly according to an embodiment of the present invention.

Now referring to the drawings, preferred embodiments of the invention are described below.

Figure 2:
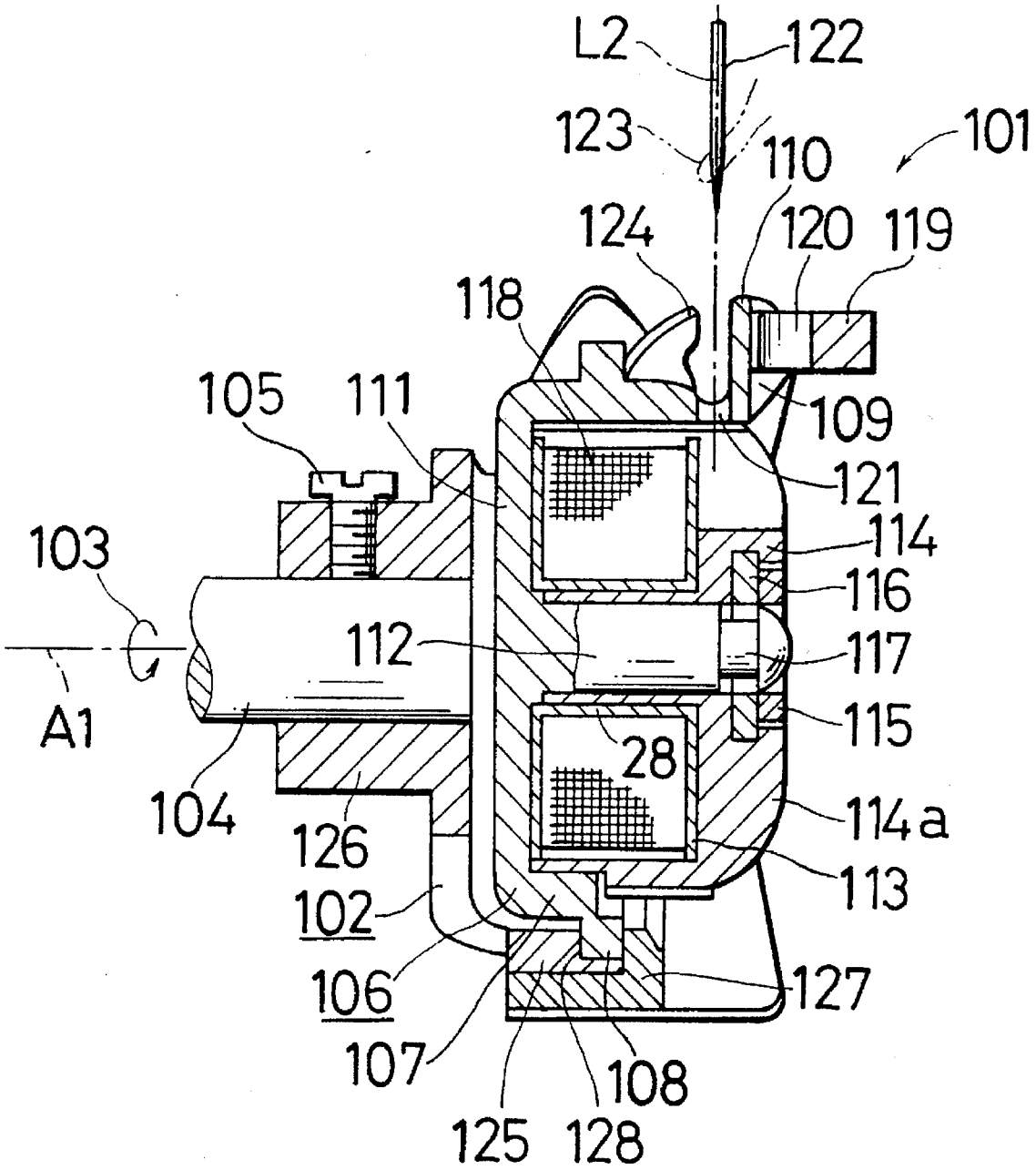
FIG. 2 is a sectional view showing the overall construction of such vertical rotary hook assembly.
Figure 3:
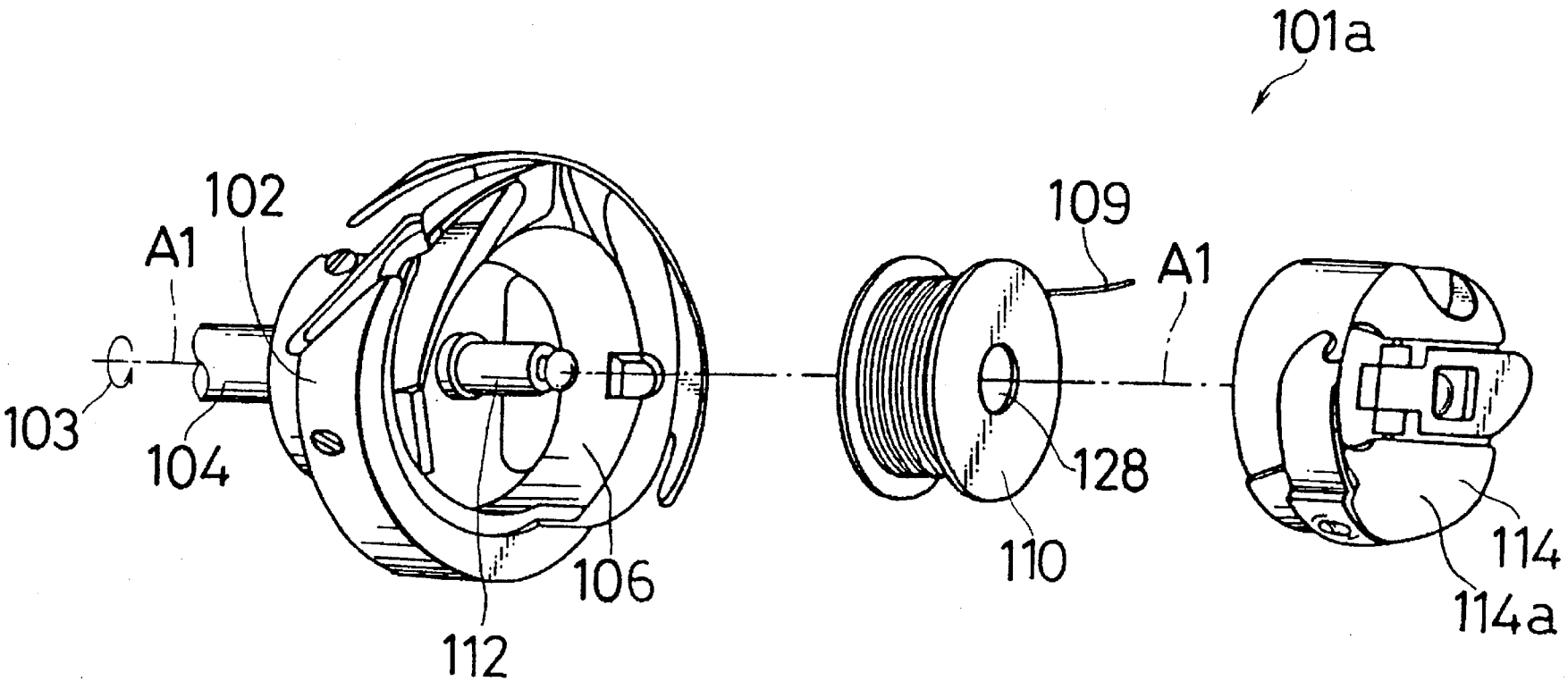
FIG. 3 is a fragmentary perspective view of such vertical rotary hook assembly.

FIG. 1 is a perspective view of a vertical rotary hook assembly 101 having a horizontal rotation axis A1 according to an embodiment of the present invention. FIG. 2 is a sectional view showing the overall construction of the vertical rotary hook assembly 101 according to this embodiment. FIG. 3 is a fragmentary perspective view of the rotary hook assembly 101. Hook 102 is fixed by bolt 105 to a shaft 104 which is driven to rotate about horizontal rotation axis A1 in the direction indicated by the arrow 103 and rotates therewith about the axis A1. The hook 102 constructed in this manner receives a bobbin case basket assembly 106.

Figure 4:
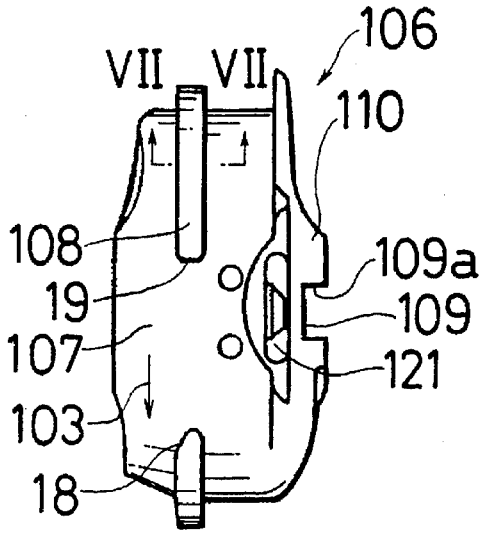
FIG. 4 is a plan view of a bobbin case basket assembly as seen from the top in FIG. 2.
Figure 5:
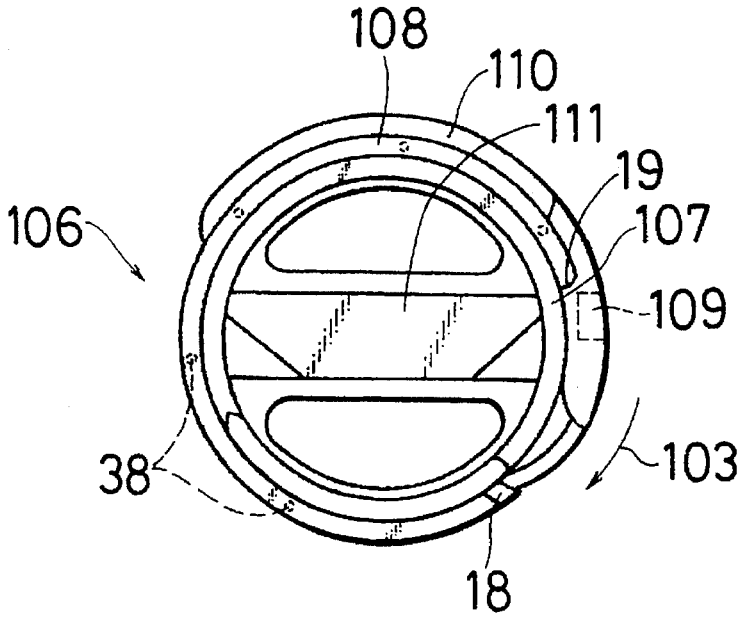
FIG. 5 is a rear view of the bobbin case basket assembly as seen from the left in FIG. 2.
Figure 6:
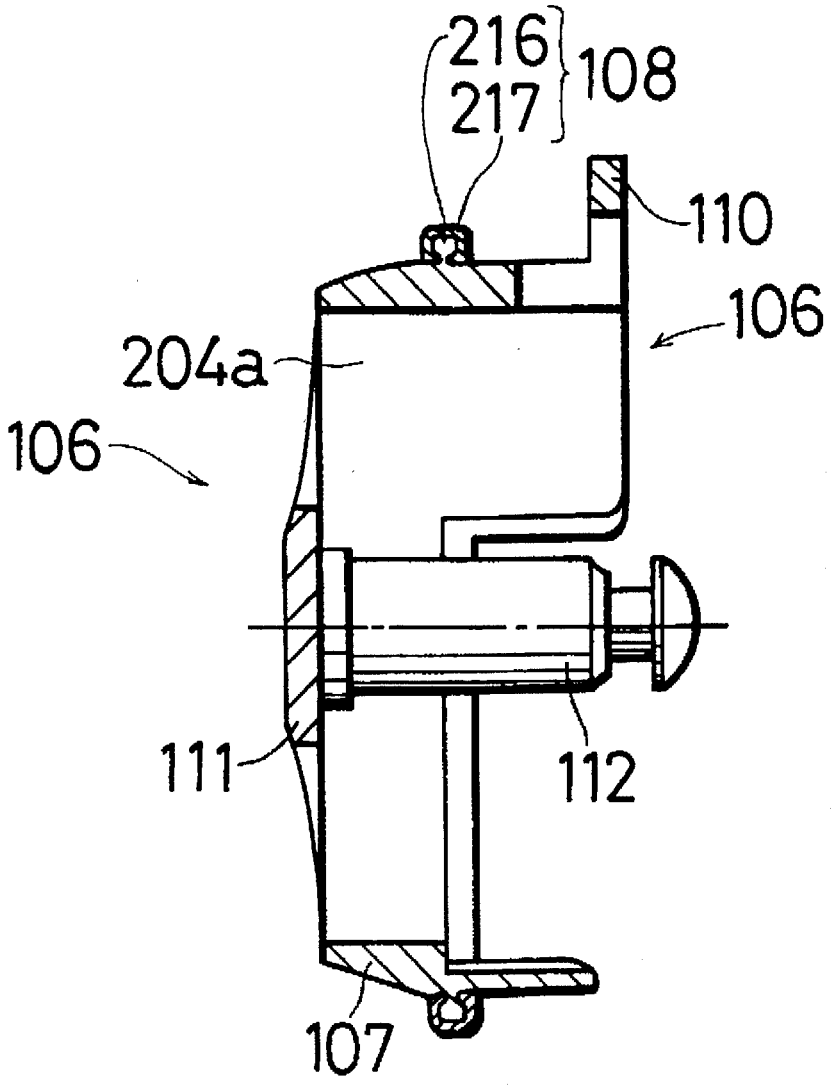
FIG. 6 is a sectional view of such bobbin case basket assembly.

Referring to FIG. 4 showing a plan view as seen from the top in FIG. 2, FIG. 5 showing a rear view and FIG. 6 showing a longitudinal section, the bobbin case basket assembly 106 comprises a cylindrical section 107, a bearing rib 108 formed on the outside circumference of the cylindrical section 107, a flange section 110 having a bobbin case basket rotation stop recess 109 formed at one end of the cylindrical section 107 at the side of the open end of the bobbin case basket (the right end in FIG. 4), and a bottom 111 called a "bridge" which extends diametrally across the other end of the cylindrical section 107. On the bottom 111 is a stud 112 that extends coaxially with the cylindrical section 107 toward the open end of the bobbin ease basket. A bobbin 113 and a bobbin case 114 are engaged on stud 112.

A protrusion 120 of a position finger 119 secured to a sewing machine body (not shown) is engaged in rotation stop recess 109, with a gap therebetween, in order to prevent rotation of the bobbin case basket 106 during rotation of the hook. The gap is about 0.7 mm in both axial and radial directions, and it is necessary for a needle thread to pass therethrough. In the cylindrical section 107 is formed a needle dropping hole 121 through which a needle 122 is reciprocated along an axis A2, in synchronization with the rotation of the hook. Needle thread 123 which has passed through the needle 122 is seized by a hook point 124 formed on the hook 102, and goes around the bobbin case basket 106 to form a seam. The bobbin case basket 106 is chiefly made of steel.

The hook member 102 comprises a cylindrical section 125 on which the hook point 124 is formed, a base section 126 formed integrally with the cylindrical section 125 and into which the shaft 104 is inserted, and a hook gib 127 secured with a screw (not shown) to the end of the cylindrical section 125 at the side of the open end thereof. In the inside circumference of the cylindrical section 125 is formed a groove shaped bearing raceway 128 into which bearing rib 108 is fitted. The hook 102 is chiefly made of steel.

FIG. 6 is a sectional view of the bobbin case basket 106. The bearing rib 108 is formed around cylindrical section 107 of the bobbin case basket 106. The bearing rib 108 comprises a rib base section 216 and a coating member 217.

in this embodiment, the coating member 217 is not provided on a loop-spreading section 18 of rib 108. Nonetheless, the loop-spreading section 18 may be covered with the coating member 217 according to another embodiment of the present invention. A rail end section 19 of rib 108 may or may not be coated according to a further embodiment.

The main body of the bobbin case basket 106 may be formed of steel or a metal such as stainless steel, a synthetic resin, an inorganic material such as ceramic, or the like.

Figure 7:
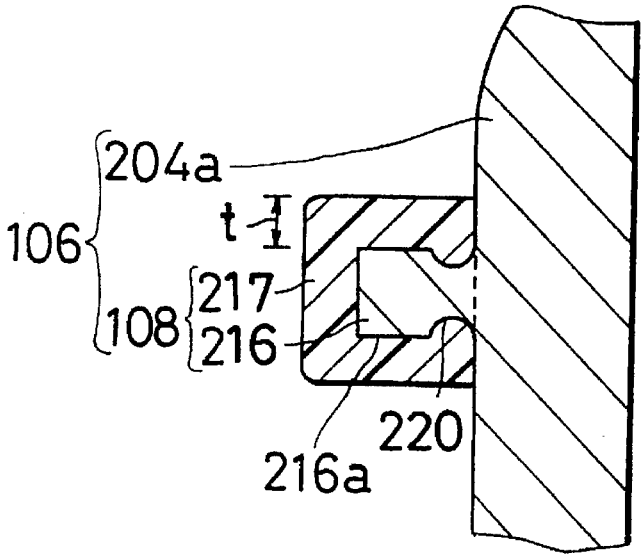
FIG. 7 is an enlarged sectional view taken along the section line VII—VII of FIG. 4.

FIG. 7 is an enlarged sectional view of the bearing rib 108 and its vicinity of the bobbin case basket 106 shown in FIG. 6. A main body 204*a* and the basic bearing rib section 216 of the bobbin case basket 106 are made of steel, and coating member 217 comprising a liquid crystal polymer with a thickness t of 0.3–0.5 mm is formed integrally by, for example, outsert molding, on outer surface 216*a* of the bearing rib section 216. Since the coating member 217 is formed to have a sufficient thickness in this manner, durability is improved. Dislocation is also prevented because a part of the coating member 217 is fitted in a groove 220 formed in the bearing rib section 216.

Art explanation will now be given regarding the details of the liquid crystal polymer used for formation of the coating member 217. The polymer comprises bar-like rigid components, and the polymer backbone thus has a great intermolecular force and crystallizes with a high orientation when molded. Thereby, the thermal resistance is so excellent that it does not deform, even at increased temperatures due to friction created by high-speed rotation of the hook 102, because it has a very high thermal deformation temperature. In addition, since the liquid crystal polymer comprises a rigid molecular chain and is highly orientated in the direction of its flow when molded, it has high strength and a high elastic coefficient, while since the molecular chain is stretched to a maximum degree in the direction of orientation, little further stretching can be expected even upon exertion of tension. Thus, excellent creep characteristics are produced. In addition, the linear expansion coefficient is extremely low, and particularly the linear expansion coefficient in the direction of flow is as low as about $1\times10^{-5}$ cm/cm/° C. This linear expansion coefficient is lower than those of other synthetic resins by one order of magnitude, and this enables it to provide the same dimensional stability as metals. Because of this stability, the dimensions change little even with changes in season-dependent ambient temperature and humidity. Further, since liquid crystal polymers have outstanding weatherability, they may be used for a long period of time. It is also to be noted that because of the low degree of phase change attributable to similar structures in their molten and solidified states, the volumes of liquid crystal polymers change only little even when solidified.

Figure 8:
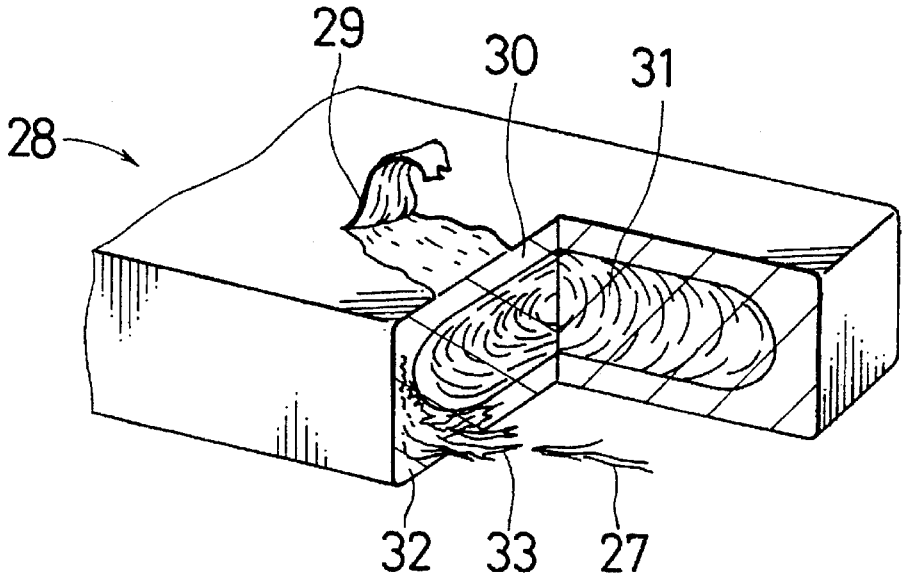
FIG. 8 is a partially cutaway perspective view of a liquid crystal polymer injection molded piece.

FIG. 8 is a partially cutaway perspective view of a liquid crystal polymer injection-molded piece 28 which can be used as the coating member 217. The liquid crystal polymer comprises an outer skin layer 29 with molecular chains highly orientated in the direction of flow, an inner skin layer 30 and a poorly orientated core layer 31. The thickness of the skin layers 29 and 30 are almost constantly 0.3–0.2 mm regardless of the thickness of the molded articles. The liquid crystal polymer is plasticated by heating and is forced into a sealable mold which is then sealed, and the polymer is cooled to a solid and then removed from the opened mold. Since the liquid crystal polymer may be molded into a coating member in this way, processing is easy and productivity is improved.

Since the respective skin layers 29 and 30 are highly orientated in the direction of flow, the liquid crystal polymers have excellent mechanical properties, including high strength and high elastic coefficients. This ease of orientation, however, tends to create anisotropy, and a reinforcing agent is preferably introduced into the rigid backbone so as to diminish such anisotropy. The ease of orientation also tends to produce fibrils peeled off from the respective skins 29 and 30. Macrofibril 32 is 5 μm, fibril 33 is 0.5 μm, and microfibril 27 is 0.05 μm. Since the liquid crystal polymers have a multi-layer structure comprising the outer skin layer 29, inner skin layer 30, core layer 31, etc., vibration damping properties are outstanding in spite of their high elastic coefficients.

By using liquid crystal polymers, wear of the surfaces of the bearing rib 108 and the groove shaped bearing raceway 128 is minimal even after high-speed sewing operation without hook lubrication for an extended period of time, and durability is exceptionally increased. In addition, according to another embodiment, the coating member 217 is stripped off the loop-spreading section 18 of the steel bearing rib section 216 along which the thread passes, and thus the formation of "thread print" is prevented. Further, because of the frictional characteristic of the liquid crystal polymers, contact stress in the direction of rotation 103 of the hook 102 between upstream side wall 109*a* of the recess 109 and the position finger 120 (119) is minimized. Accordingly, the needle thread can pass therebetween during its travel between the wall 109*a* and the position finger 120 at constant tension, and sewing quality is improved.

Figure 9:
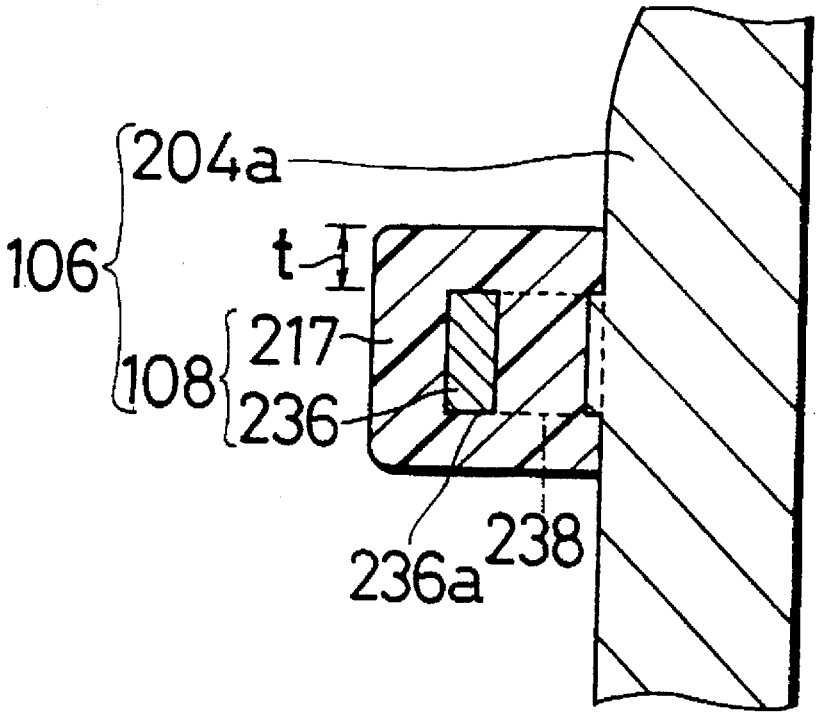
FIG. 9 is an enlarged sectional view similar to FIG. 7, of a bobbin case basket assembly according to another embodiment of the present invention.

FIG. 9 is an enlarged sectional view of a bobbin case basket 106 according to another embodiment of the present invention, taken along the section line VII—VII of FIG. 4. The bobbin case basket main body 204*a* and bearing rib section 236 with a hole 238 are made of steel. Formed integrally on outer surface 236*a* of the bearing rib section 236 is a liquid crystal polymer coating member 217 having a thickness t of 0.3–0.5 mm, with a part of the liquid crystal polymer extending through and filling the hole 238. By providing the hole 238 in the bearing rib section 236 and filling the hole 238 with the liquid crystal polymer, displacement of the coating member 217 is prevented more reliably.

Figure 10:
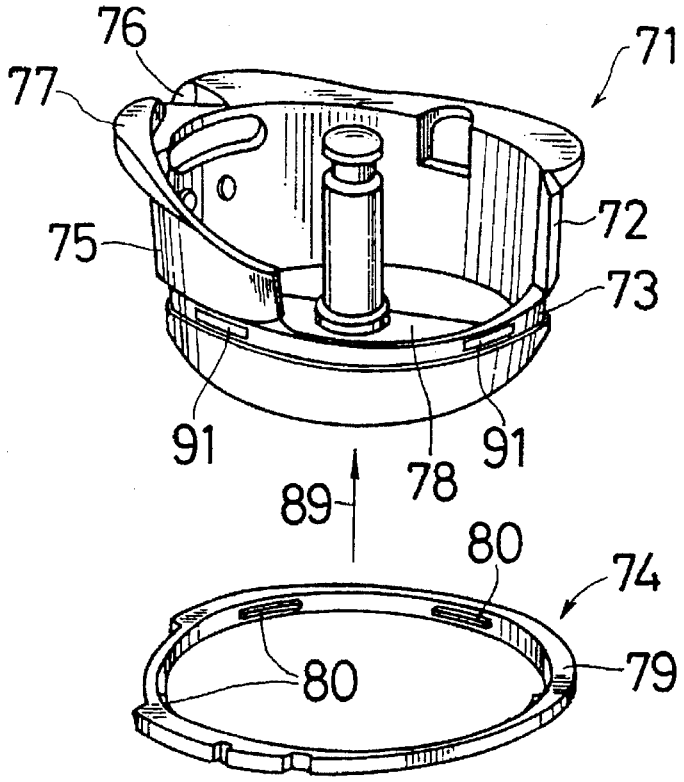
FIG. 10 is a fragmentary perspective view of a bobbin case basket assembly according to a further embodiment of the present invention.

FIG. 10 is a fragmentary perspective view of a bobbin case basket 71 according to a further embodiment of the present invention, for a vertical rotary hook assembly. The bobbin case basket 71 basically comprises a bobbin case basket main body 72 and a built-in bearing rib member 74 secured to a fitting groove 73 formed in the outside circumference of the bobbin case basket main body 72.

Figure 11:
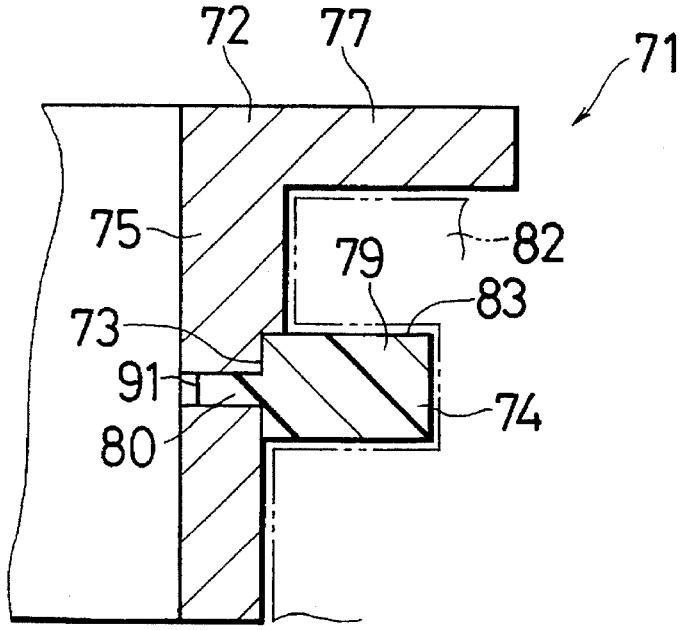
FIG. 11 is a sectional view showing a fitting groove and its vicinity of such bobbin case basket assembly.

FIG. 11 is a sectional view showing fitting groove 73 and its vicinity. The built-in bearing rib member 74 is fitted in the fitting groove 73. Bearing rib member 74 comprises a bearing rib 79 and fitting protrusions 80 extending radially inwardly therefrom. In the fitting groove 73 are formed fitting holes 91 that correspond to the protrusions 80. The plurality of protrusions 80 and the fitting hole 91 extend and are spaced circumferentially.

Figure 12:
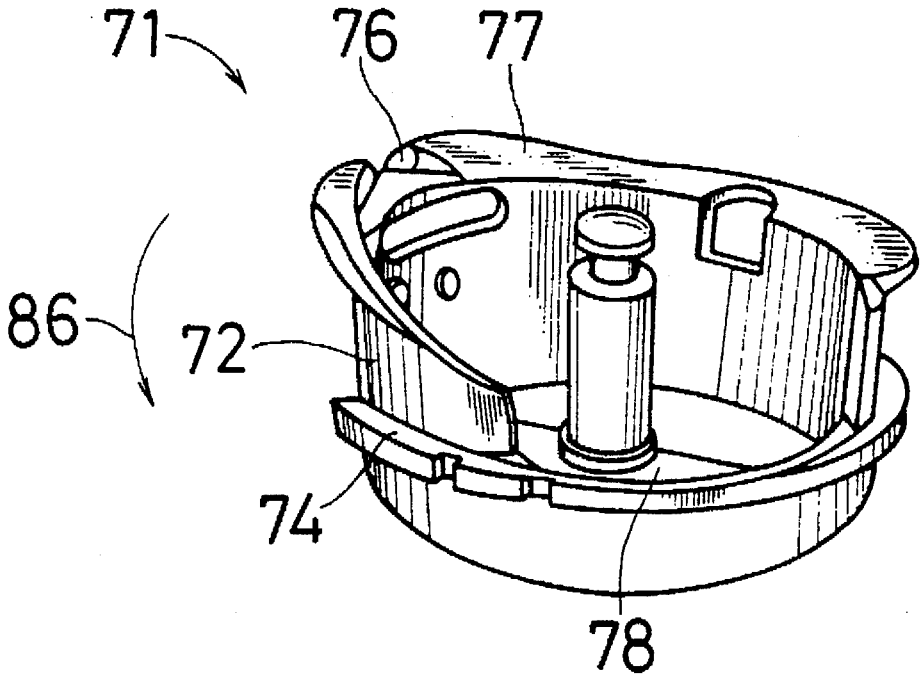
FIG. 12 is a perspective view of the bobbin case basket assembly according to the above embodiment of FIG. 10 of the present invention.

FIG. 12 is a perspective view showing the state of the assembled bobbin case basket 71. Bearing rib member 74 is fitted in groove 73 of the bobbin case basket main body 72 in a secured manner.

The bearing rib member 74 is composed of a synthetic material which is a synthetic resin such as a liquid crystal polymer, aromatic polyimide resin or the like. The endless annular bearing rib 79 has an elastic force, by which the bearing rib of the bearing rib member 74 may he forced, for fitting, onto cylindrical section 75 of the bobbin case basket main body 72 as indicated by the reference number 89 (FIG. 10). The fitting protrusions 80 are fitted properly and elastically in fitting holes 91. In this way the bearing rib 79 is secured to the bobbin case basket main body 72 in a detachable manner so that a worn rib can be replaced. The bearing rib member 74 may be secured to the bobbin case basket main body 72 so as to prevent removal for replacement. The inner surface configuration of the fitting holes 91 are almost identical to the outer surface configuration of the fitting protrusions 80, and fitting protrusions 80 are fixedly fitted into fitting holes 91. Although the bearing rib member 74 is formed as an endless ring according to the foregoing embodiment, it may consist only of a bearing rib 79 which is roughly C-shaped.

According to the present invention, the bearing rib of the bobbin case basket or at least its surface layer is made of a liquid crystal polymer or aromatic polyimide resin as demonstrated in the foregoing embodiments. With such design, low torque rotation of the hook due to the reduced friction between the bearing rib and the groove shaped bearing raceway which is an object of the present invention may be accomplished. The use of the liquid crystal polymer or aromatic polyimide resin produces the following three important effects:

(a) It is possible to drive the hook assembly with reduced rotating resistance between the hook and the bobbin case assembly. Particularly, the rotating resistance is lower in the arrangement of the present invention without hook lubrication than in a conventional arrangement with hook lubrication. In other words, the rotating resistance is reduced with the invention, even when of the oil-free type;

(b) Use of such an oil-free the clearance or gap between the bearing rib and groove shaped bearing raceway of the hook to be extremely small compared with use of other synthetic resins, for example, a fluororesin such as TEFLON (trade name). Thus, durability is exceptionally excellent; and (c) Use of the oil-free arrangement reduces the frequency of occurrence of incidental looping and thread breakage, as compared with use of oil-feed arrangements such as all steel hook assemblies, and also there is no oil staining of the sewing threads by hook lubricants. Accordingly, better sewing quality is realized.

Figure 13:
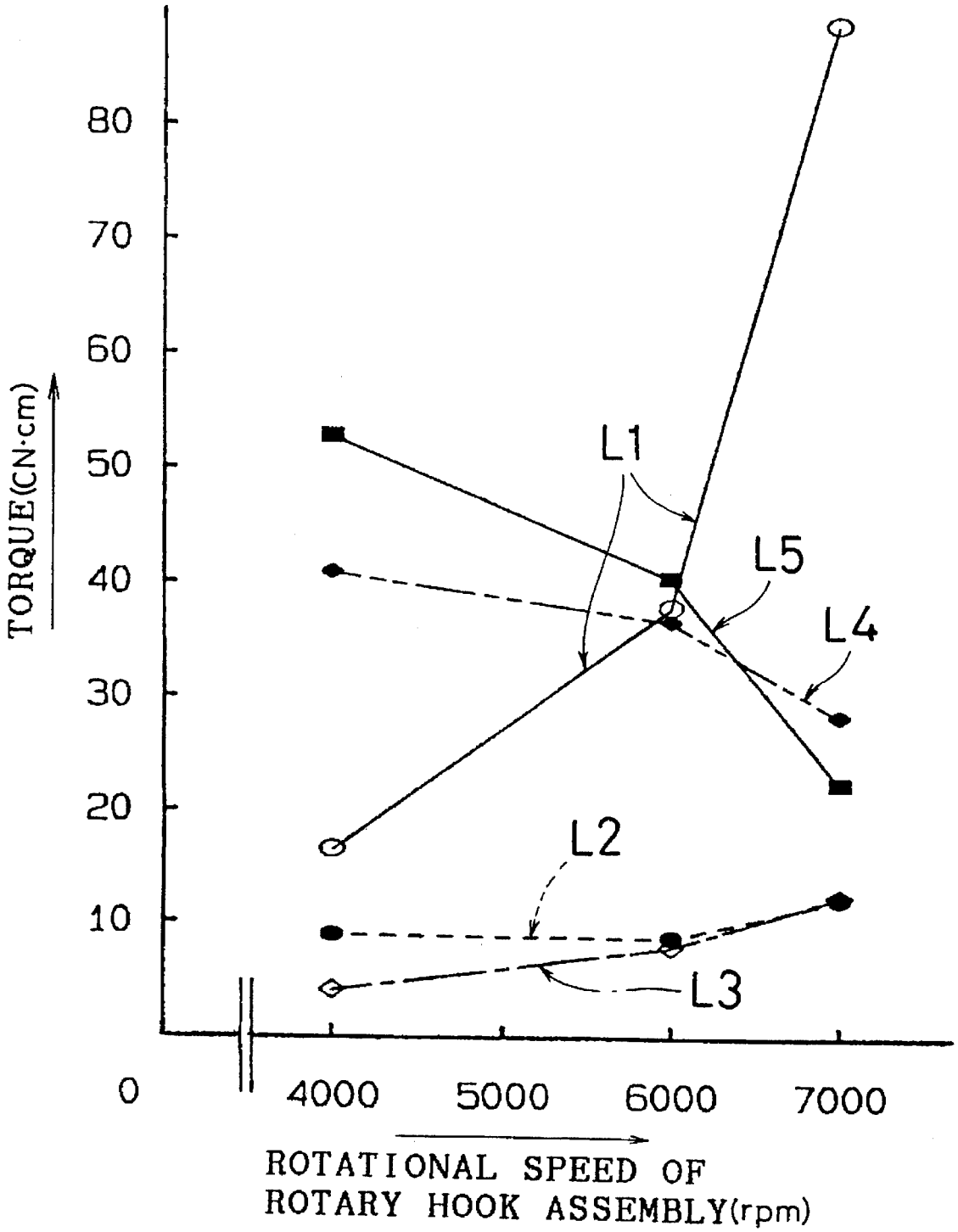
FIG. 13 is a graph showing torques which work on a position finger of a sewing machine by hook rotation in the experiments performed by the present inventors according to an embodiment of the present invention and a comparison.

It is apparent from FIG. 13, which shows the results of experiments performed by the inventors, since the bearing rib or at least the surface layer thereof is composed of a liquid crystal polymer, the friction coefficient between the surface layer and the groove shaped bearing raceway of the hook is lowered.

Lines L1 and L2 in FIG. 13 represent the rotating performance of the hook assembly of the constructions shown in FIG. 10 through FIG. 12, but wherein the bobbin case main body 72 is made of steel and the bearing rib member 74 mounted thereon is composed of TEFLON (trade name), a fluororesin.

TABLE 1

| FIG. 13 | SURFACE LAYER OF BEARING RIB | OIL |
|---|---|---|
| L1 | Fluororesin | Not fed. |
| L2 | Fluororesin | Fed. |
| L3 | Liquid crystal polymer | Not fed. |
| L4 | Liquid crystal polymer | Fed. |
| L5 | Steel | Fed. |

When the rotational speed of the hook 102 is 4,000–7,000 rpm, it will be understood, as is clearly indicated by Line L1, that fluororesins cannot be used without hook lubrication. In the cases represented by Line L2 where a fluororesin is used and with hook lubrication, although the torque from the rotation of the hook 102 is greatly reduced, the hook lubricant may present the serious problem of oil staining of the sewing threads.

In the case of using conventional vertical rotary hook assemblies whose bobbin case baskets and hooks are made of steel, as indicated by Line L5 in FIG. 13, even if there is hook lubrication, the force exerted on the bobbin case basket 71 due to the rotation of the hook 102 is excessively increased. As a result, the contact stress between the bobbin case basket stop recess 109 and the position finger 120 is increased correspondingly. This in turn causes an increase in tension of the needle thread passage between the contact sections, resulting in poor sewing quality.

In vertical rotary hook assemblies according to the present invention, the bobbin case basket main body 72 is made of steel, and the bearing rib member 74 is composed of a liquid crystal polymer. It has been proved that with an oil-free arrangement, as indicted by Line L3, even under the condition of high-speed rotation without hook lubrication, the contact stress between the bobbin case basket stop recess 109 and the position finger 120 is lower than in cases with hook lubrication, and is also desirably lower than cases of a conventional oil-feed type of steel-made vertical rotary hook assembly, shown by Line L5.

It has been proved that the above vertical rotary hook assembly equipped with a bearing rib member composed of such a liquid crystal polymer causes increases in contact stress, as indicated by Line L4. Accordingly, in the present invention it will be easily understood that the torque may be desirably lowered without hook lubrication.

Since the bearing rib or at least its surface layer is made of a liquid crystal polymer, the clearance or gap between the bearing rib member 74 and the groove shaped bearing raceway of the hook is kept almost constant, thus minimizing wear. This is apparent from FIG. 14 which shows the results of experiments performed by the inventors.

TABLE 2

Figure 14:
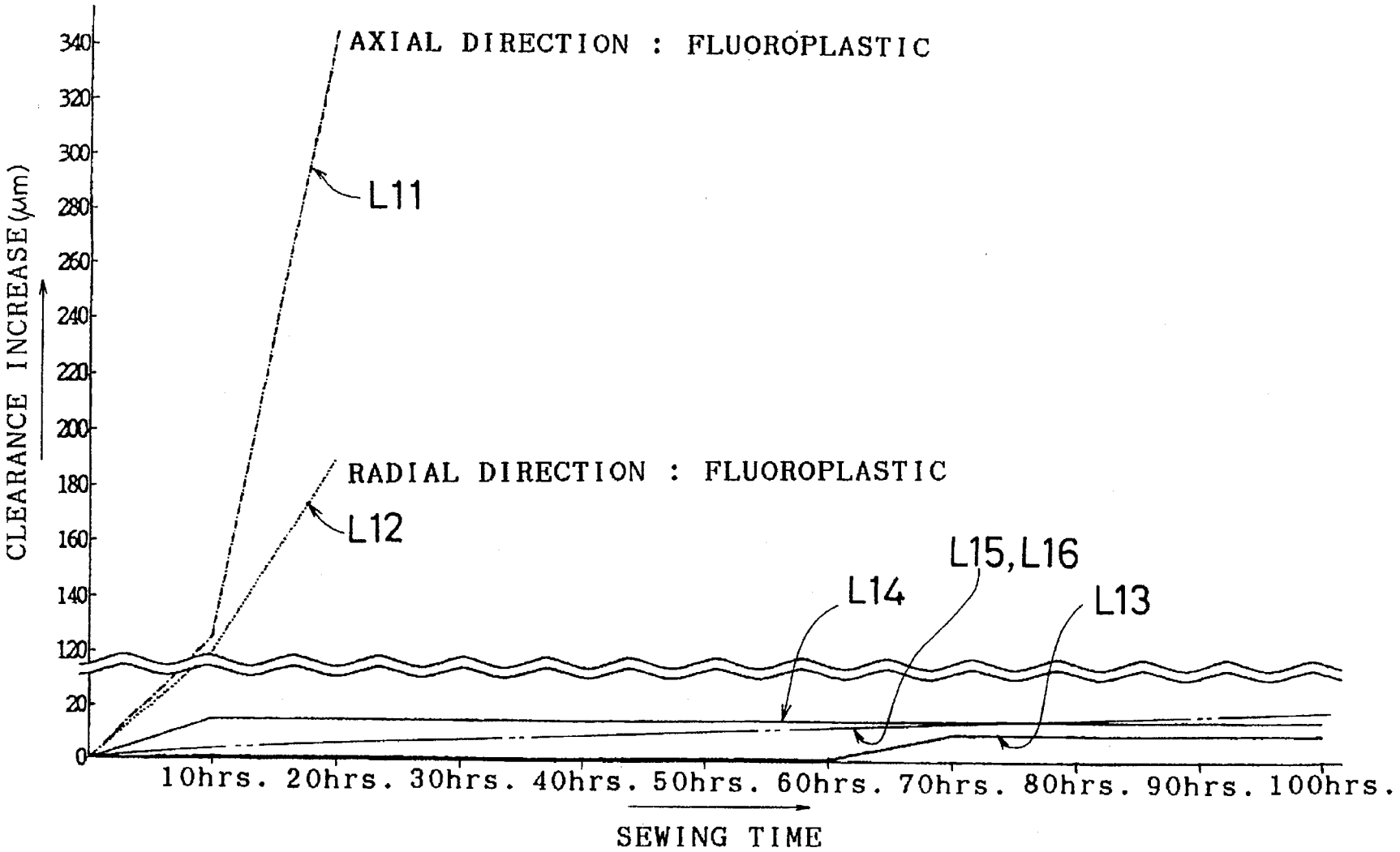
FIG. 14 is a graph showing an increase in a clearance or gap between a bearing rib on the bobbin case basket and a groove shaped bearing raceway in the hook with lapse of hook rotating time in the experiments performed by the present inventors according to an embodiment of the present invention and a comparison.

| FIG. 14 | DIRECTION OF CLEARANCE | SURFACE LAYER OF BEARING RIB | OIL |
|---|---|---|---|
| L11 | Axial | Fluororesin | Not fed. |
| L12 | Radial | Fluororesin | Not fed. |
| L13 | Axial | Liquid crystal polymer | Not fed. |
| L14 | Radial | Liquid crystal polymer | Not fed. |
| L15 | Axial | Steel | Fed. |
| L16 | Radial | Steel | Fed. |

In the constructions shown in FIG. 14, the hook 102 is made of steel, and the bobbin case basket main body 72 is also made of steel. Lines L13 and L14 represent the construction wherein a liquid crystal polymer bearing rib member 74 is provided. The hook 102 rotates at a rotational speed of 6,500 rpm. In the oil-free constructions represented by Lines L11 and L12 where the bearing rib member is made of a fluororesin, the increases in the clearance occur rapidly in a relatively short sewing time, and such construction cannot be used for vertical rotary hook assemblies. On the other hand, according to the constructions represented by Lines L13 and L14 where the bearing rib member 74 is made of a liquid crystal polymer and the hook rotates without hook lubrication, increases in the clearance are very small and almost constant, and the performance is similar to that of the conventional construction represented by Line L15 wherein both the bobbin case basket and hook are made of steel and rotates with hook lubrication. However, it is well known that the conventional steel rotary hook assemblies cannot be used for high-speed rotation without feeding oil because of overheating. It has been proved by the above results that in the case of using a bobbin case basket at least the surface layer of which is coated with a liquid crystal polymer as in the constructions represented by Lines L13 and L14, even without feeding oil, the durability of the rotating portion of the hook assembly is better.

Figure 15:
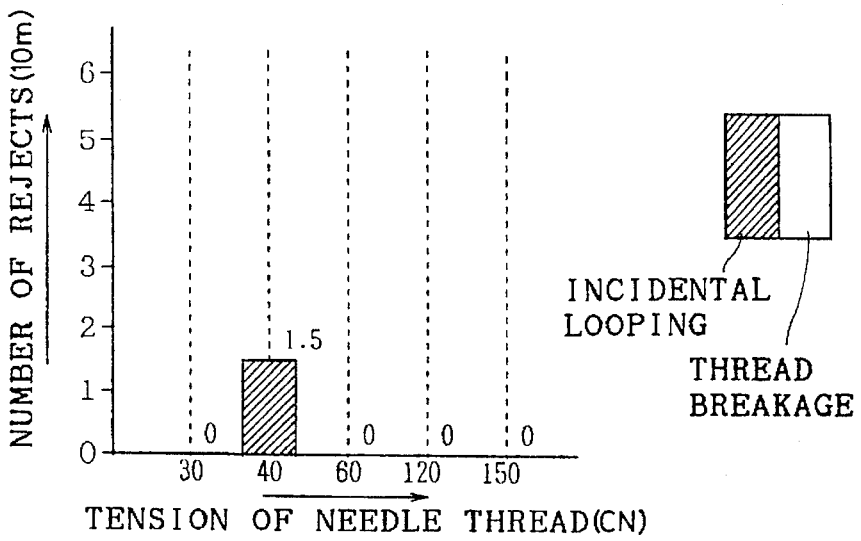
FIG. 15-(1)–15(3) are graphs showing sewing quality when polyester filament #50 threads were used in the experiments performed by the present inventors according to an embodiment of the present invention and a comparison.
Figure 15:
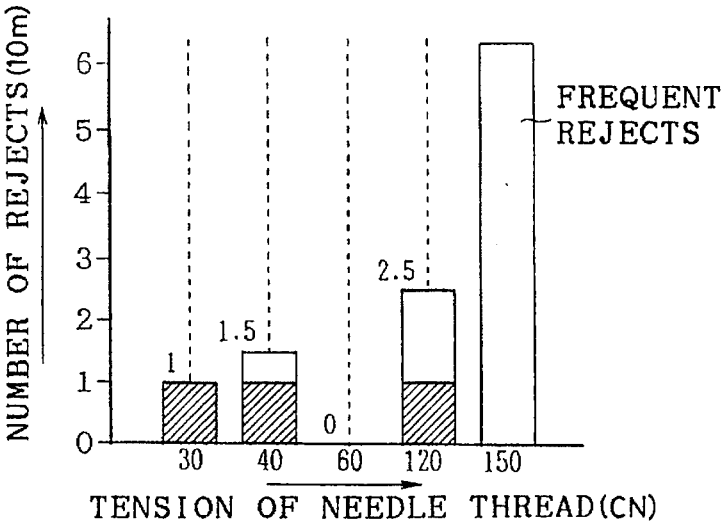
Figure 15:
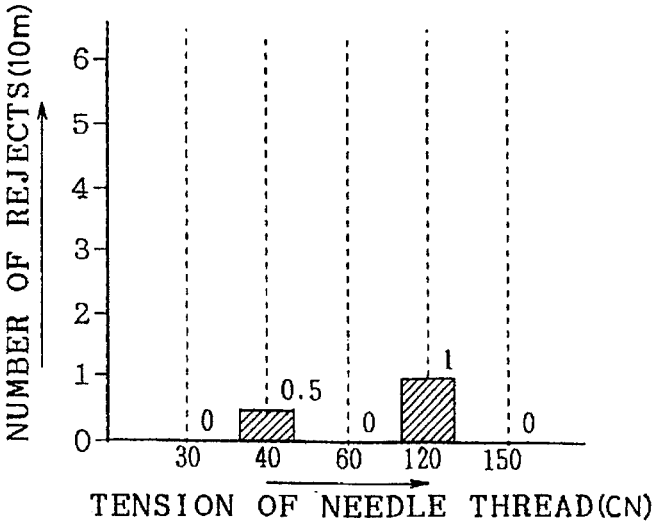
Figure 16:
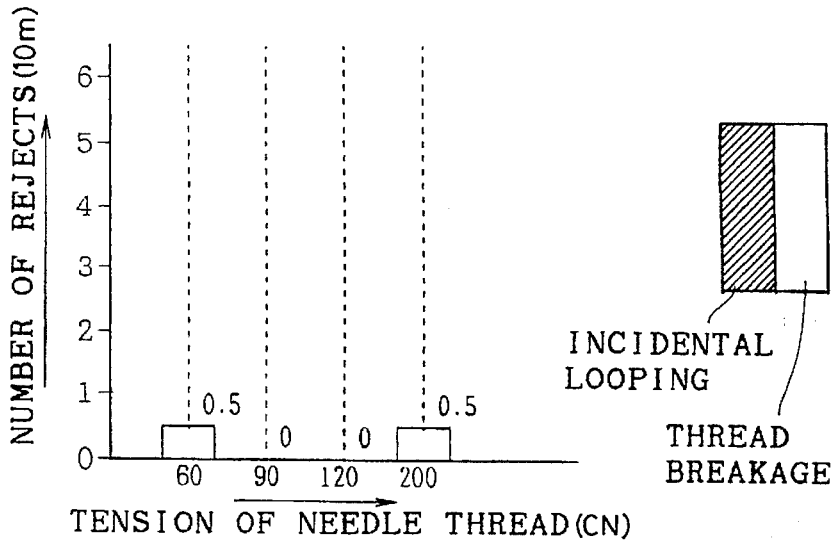
FIGS. 16(1)–16(3) are graphs that are the same as FIGS. 15(1)–15(3), except that polyester spun #60 thread was used.
Figure 16:
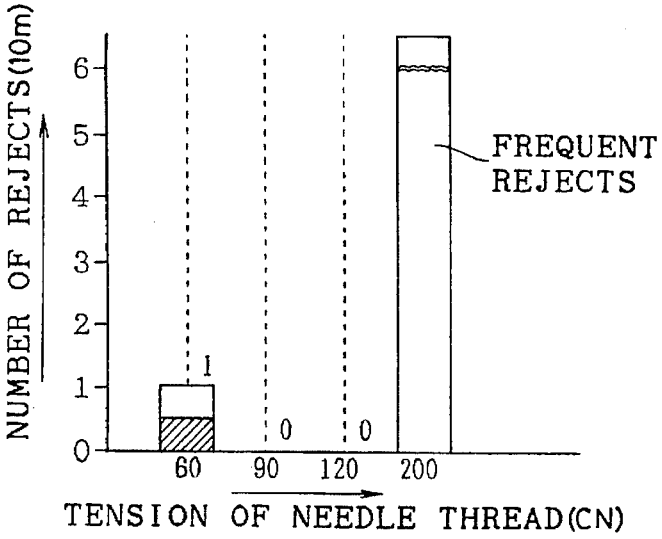
Figure 16:
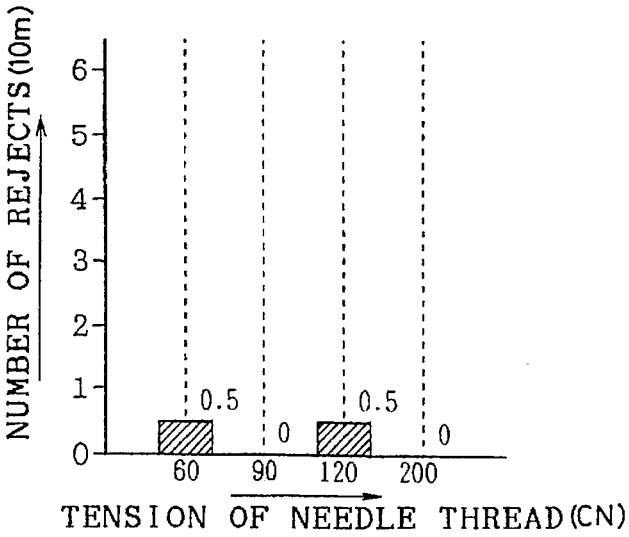
Figure 17:
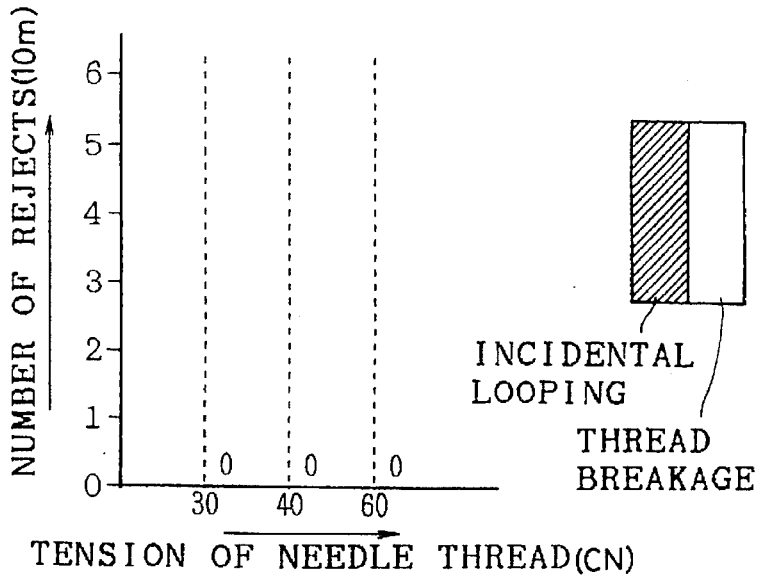
FIGS. 17(1)–17(3) are graphs that are the same as FIGS. 15(1)–15(3) or FIGS. 16(1)–16(3), except that cotton #120 thread was used.
Figure 17:
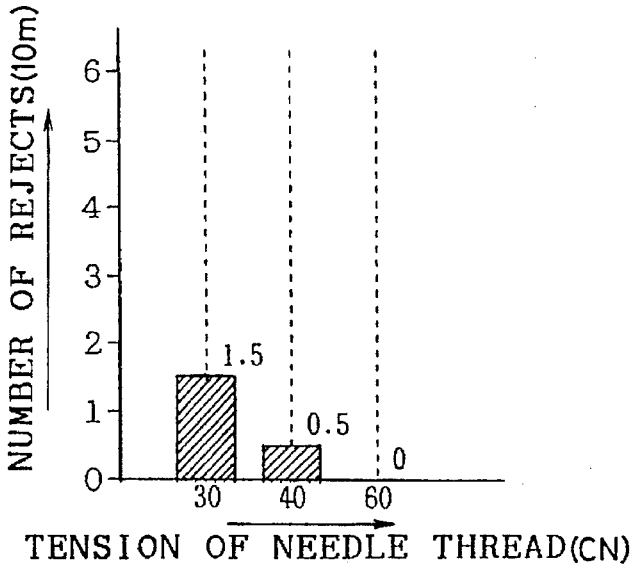
Figure 17:
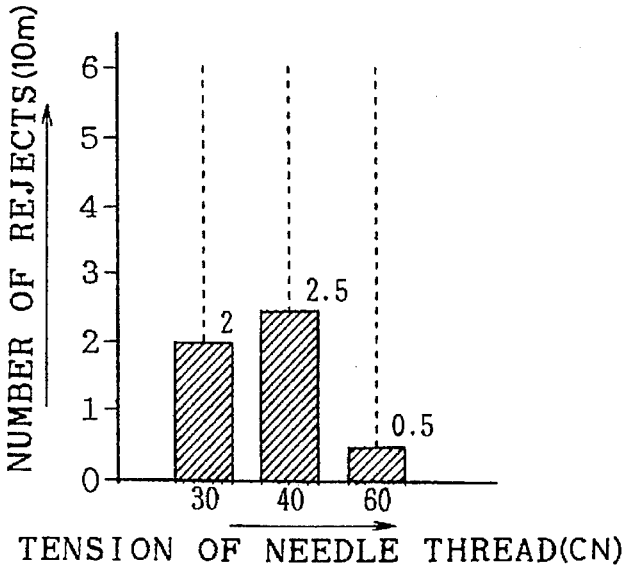

In addition, it is apparent that the use of the bobbin case basket with the bearing rib member 74 at least the surface layer of which is composed of a liquid crystal polymer diminishes the frequency of occurrence of sewing rejects due to incidental looping or, thread breakage, and improves sewing quality, as is evident from FIG. 15 through FIG. 17 which show the results of experiments performed by the inventors.

TABLE 3

| DRAWINGS | SURFACE LAYER OF BEARING RIB | OIL | THREADS |
|---|---|---|---|
| FIG. 15 | | | |
| (1) | Liquid crystal polymer | Not fed. | TETRON #50 Polyester Filament |
| (2) | Liquid crystal polymer | Fed. | |
| (3) | Steel | Fed. | |
| FIG. 16 | | | |
| (1) | Liquid crystal polymer | Not fed. | Polyester Spun #60 |
| (2) | Liquid crystal polymer | Fed. | |
| (3) | Steel | Fed. | |
| FIG. 17 | | | |
| (1) | Liquid crystal polymer | Not fed. | Cotton #120 |
| (2) | Liquid crystal polymer | Fed. | |
| (3) | Steel | Fed. | |

It will be understood that particularly the oil-free construction using a liquid crystal polymer greatly improves sewing quality. In FIG. 15 through FIG. 17, the hook rotates at a rotational speed of 6,000 r.p.m.

In FIG. 15 through FIG. 17, the bobbin case assembly with a bearing rib whose surface layer is composed of a liquid crystal polymer comprises a steel bobbin case basket main body 72 and a liquid crystal polymer bearing rib member 74. The entirety of the bobbin case basket is made of steel in cases where the bearing rib is specified to have a steel surface layer. In these experiments, the hooks were made of steel. In the experiments with hook lubrication, industrial machine oil was used. These results clearly demonstrate that, regardless of the kind of the needle and bobbin threads, the frequency of occurrence of sewing rejects due to incidental looping or thread breakage is lowered in the case of the embodiments which utilize a bobbin case basket with the rib thereof made of using liquid crystal polymers, and particularly the frequency of occurrence of such rejects is made lower in the case without hook lubrication, and sewing quality is improved.

It will be understood that since at least the surface layer, of the bearing rib is composed of a liquid crystal polymer, the above effects a, b and c are realized.

Also, all the embodiments of FIG. 1 through FIG. 10 produced the same experimental results as in FIG. 15 through FIG. 17, and these results prove the excellent construction of the present invention.

Similar preferable results were obtained in experiments similar to those above, but using only an aromatic polyimide resin instead of the liquid crystal polymer.

According to another embodiment of the present invention, all the components of the bobbin case assembly may be made of synthetic resins such as liquid crystal polymers or aromatic polyimide resins, which possess the properties mentioned above. In this case, the strength of the bobbin case basket main body is weaker as compared with other embodiments. Also other synthetic resins, not limited to liquid crystal polymers and aromatic polyimide resins, may be used as long as they have the above properties.

Figure 18:
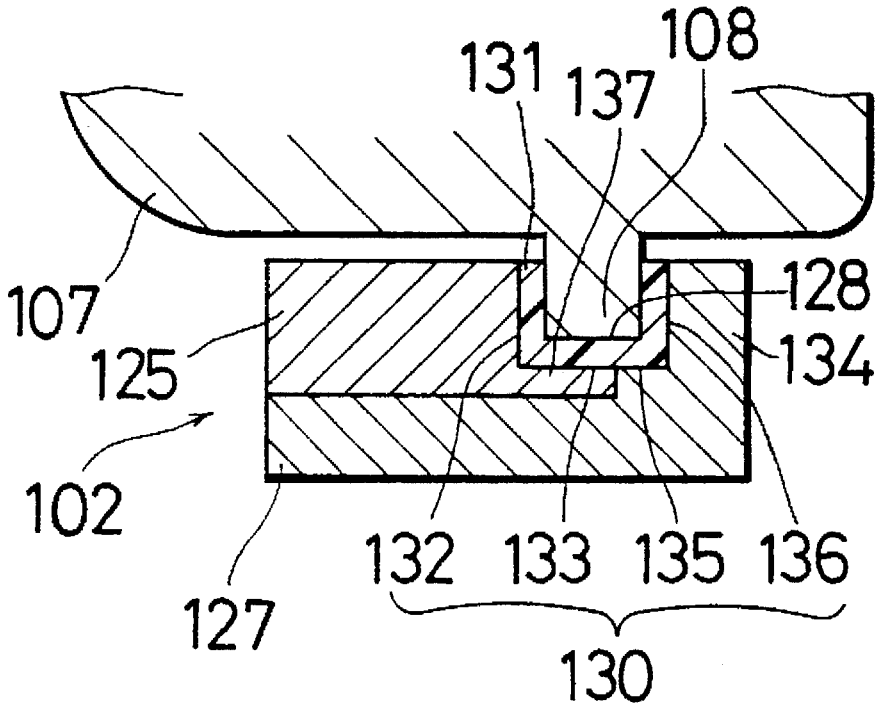
FIG. 18 is a partially enlarged sectional view of a bearing rib, a groove shaped bearing raceway and their vicinity in a case where a slide member is provided according to a further embodiment of the present invention.

FIG. 18 is a partially enlarged sectional view of a bearing rib 108, a groove shaped bearing raceway 128 and their vicinity according to a further embodiment of the present invention. In this embodiment, a recess groove 130 is formed in the inside circumference of the hook 102, and a U-shaped section slide member 131 having 0.3–0.5 mm thickness is fixed in this recess groove 130.

The slide member 131 is composed of a synthetic resin such as a liquid crystal polymer, aromatic polyimide resin or the like, of the same type as used in the foregoing embodiments. Also in this case the same improvement as in the other embodiments can be seen.

The present invention may be also employed for horizontal rotary hook assemblies.

Also, the hook and bobbin case basket may be prepared from the same materials used for the bearing rib.

Figure 19:
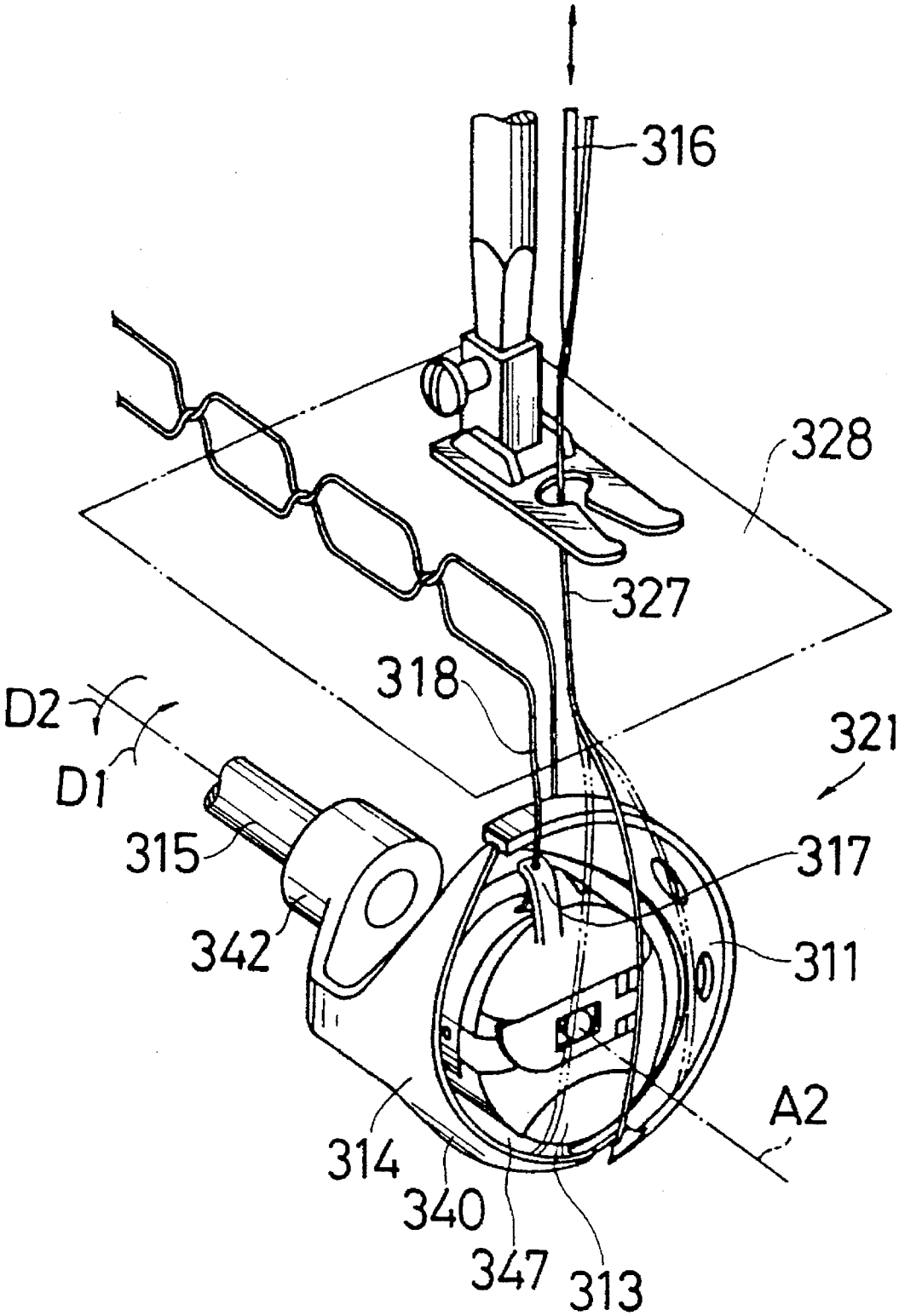
FIG. 19 is a simplified perspective view of an oscillating shuttle hook assembly according to another embodiment of the present invention.
Figure 20:
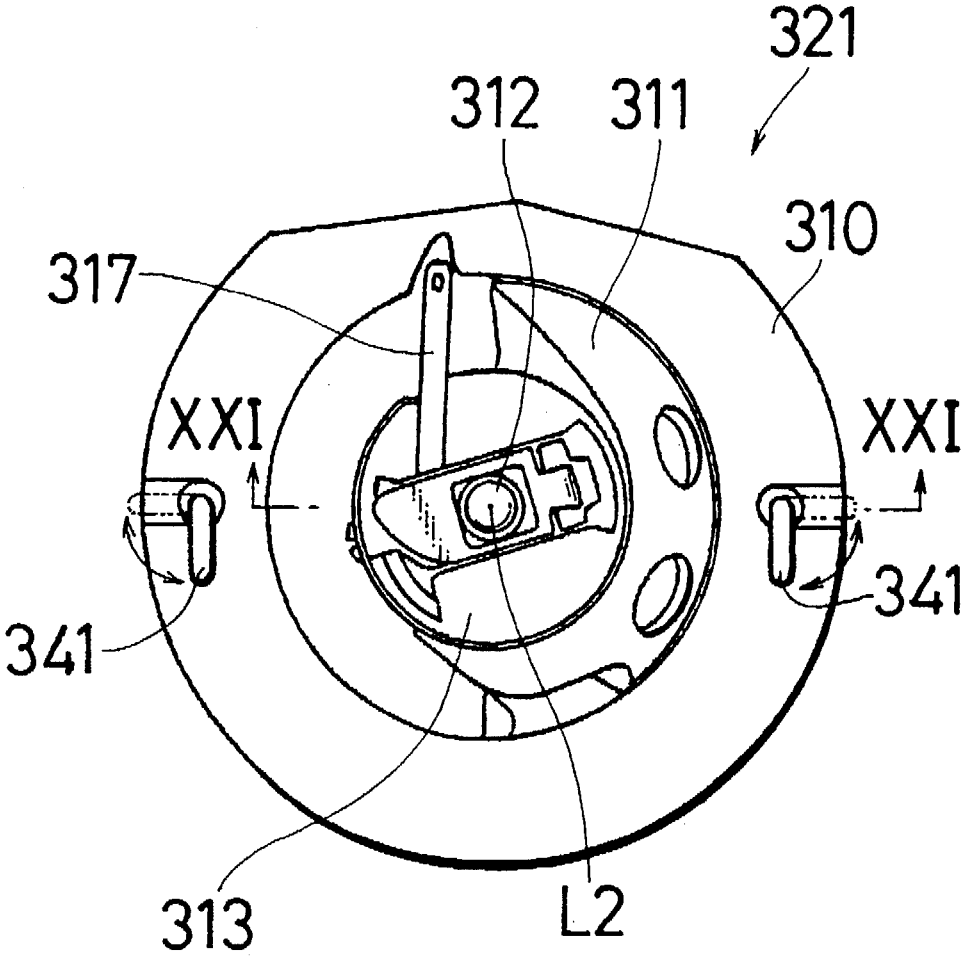
FIG. 20 is a simplified front view of the oscillating shuttle hook assembly as seen from the right in FIG. 19.

FIG. 19 is a perspective view of an oscillating shuttle hook assembly 321 according to a further embodiment of the present invention. FIG. 20 is a front view of a portion of the oscillating shuttle hook assembly 321. The oscillating shuttle hook assembly 321 is constructed such that a loop-seizing member 310 provided in a fixed position is supported by fitting an oscillating loop taker 311 thereinto in a manner capable of oscillating with respect to axis of rotation A2. A bobbin case 313 is mounted over a stud 312 of the oscillating loop taker 311. The bobbin case 313 houses a bobbin wound by bobbin thread 318. In FIG. 19, the loop-seizing member 310 is omitted for the clarity of understanding of the drawing. A driver 314 is driven by an oscillating shaft 315 to rotate half a turn in each of alternating directions as indicated by arrows D1 and D2, while a needle 316 is reciprocated up and down in synchronization with the movement of the oscillating shaft 315.

A position finger 317 is formed integrally with the bobbin case 313, and is fitted into a fitting recess of a bobbin case presser member secured to a machine body integrally with a machine bed and a throat plate 328. This construction prevents rotation of the bobbin case 313. In FIG. 20 the driver 314 is not shown.

Figure 21:
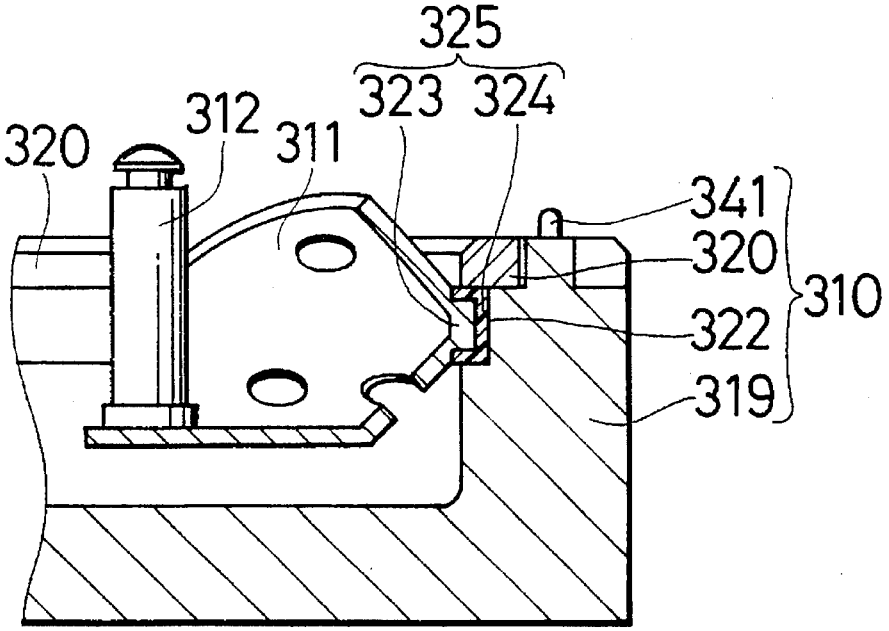
FIG. 21 is an enlarged sectional view in a simplified version taken along the section line XXI—XXI of FIG. 20.

FIG. 21 is an enlarged sectional view of a portion of the oscillating shuttle hook assembly 321, taken along the section line XXI—XXI of FIG. 20. The loop-seizing member 310 is constructed such that a shuttle race ring 320 is detachably mounted on a shuttle race body 319 with the aid of a set claw 341 which can be angularly displaced by manual operation. The shuttle race body 319 and the shuttle race ring 320 together form a bearing raceway 322. A bearing rib 325 is constructed such that a surface layer 324 having a U-shape in cross section is secured to the outside circumference of a protrusion 323 circumferentially extending from the oscillating loop@taker 311. As in the foregoing embodiments, the surface layer 324 is made of a synthetic resin such as a liquid crystal polymer, aromatic polyimide resin or the like. The loop-seizing member 310 and the oscillating loop taker 311 (parts other than the surface layer 324) may both be made of steel.

Figure 22:
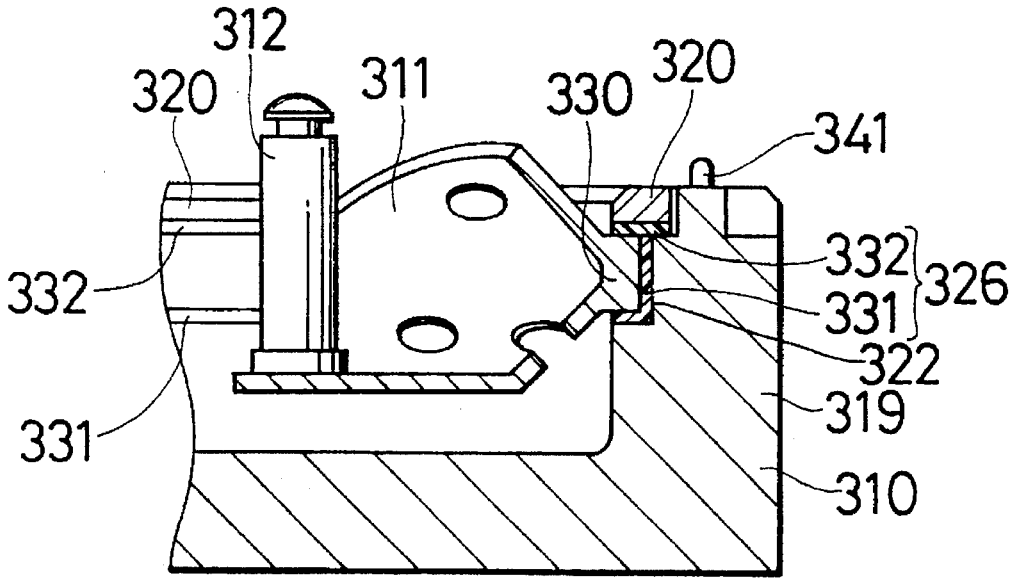
FIG. 22 is an enlarged sectional view similar to FIG. 21 but according to another embodiment of the present invention.

FIG. 22 shows a still further embodiment of the present invention. In this embodiment, similar to those described in FIG. 19 through FIG. 21, the same reference numerals are used to describe corresponding parts. In this oscillating shuttle hook assembly 321, a surface layer 326 is formed on the inside circumference of the bearing raceway 322 to which the bearing ring 325 of the oscillating loop taker 311 is fittedly secured. In the same manner as in the foregoing embodiments, the surface layer 326 is made of a synthetic resin such as a liquid crystal polymer, aromatic polyimide resin or the like. The oscillating loop taker 311 and the loop-seizing member 310 (parts other than the surface layer 326) may both be made of steel. The surface layer 326 is comprised of a surface portion 331 having an L-shape in cross section and secured to the shuttle race body 319 and a planar surface portion 332 secured to the shuttle race ring 320.

In the embodiments shown in FIG. 19 through 21, and FIG. 22, the provision of the surface layer 324 and the surface layer 326 lowers the frictional force between the loop-seizing member 310 and the oscillating loop taker 311. Accordingly, cloth and thread are free from being stained by hook lubricants such as industrial sewing machine oil.

The present invention may be carried out in various forms without departing from the spirit and the essential characteristics thereof. Accordingly, the foregoing embodiments are mere illustrations thereof from every point of view, whereas the scope of the present invention is described in the claims, and is not limited to any of the details of description. It should be noted that all variations and modifications falling within the scope of equivalence of the claims are embraced by the present invention.

What is claimed is:

1. A hook assembly for a sewing machine, said hook assembly comprising:

a bobbin case basket having an outer circumference and a circumferentially extending bearing rib on said outer circumference;

a hook member circumferentially surrounding said bobbin case basket and rotatable relative thereto, said hook member having an inner circumference having formed therein a circumferentially extending groove shaped bearing raceway;

said bearing rib fitting in said bearing raceway with an outer surface layer of said bearing rib confronting an inner surface layer of said raceway; and one of said outer surface layer and said inner surface layer being formed of steel and the other of said outer surface layer and said inner surface layer being formed of a liquid crystal polymer material having properties such that, upon rotation of said hook member relative to said bobbin case basket, friction between said outer surface layer and said inner surface layer, with no industrial sewing machine oil present therebetween, is less than friction that would occur with industrial sewing machine oil present therebetween.

2. A hook assembly as claimed in claim 1, wherein said outer surface layer is formed of said liquid crystal polymer material.

3. A hook assembly as claimed in claim 1, wherein said inner surface layer is formed of said liquid crystal polymer material.

4. A hook assembly as claimed in claim 1, wherein said bearing rib comprises a metal rib base having a rail end section and a loop-spreading section spaced circumferentially from said rail end section, and a coating member formed of said liquid crystal polymer material and defining said outer surface layer, said coating member being integrally fixed to said metal rib base except for said loop spreading section thereof.

5. A hook assembly for a sewing machine, said hook assembly comprising:

a bobbin case basket having an outer circumference and a circumferentially extending bearing rib on said outer circumference;

a hook member circumferentially surrounding said bobbin case basket and rotatable relative thereto, said hook member having an inner circumference having formed therein a circumferentially extending groove shaped bearing raceway;

said bearing rib fitting in said bearing raceway with an outer surface layer of said bearing rib confronting an inner surface layer of said raceway; and one of said outer surface layer and said inner surface layer being formed of steel and the other of said outer surface layer and said inner surface layer being formed of an aromatic polyimide resin material having properties such that, upon rotation of said hook member relative to said bobbin case basket, friction between said outer surface layer and said inner surface layer, with no industrial sewing machine oil present therebetween, is less than friction that would occur with industrial sewing machine oil present therebetween.

6. A hook assembly as claimed in claim 5, wherein said outer surface layer is formed of said aromatic polyimide resin material.

7. A hook assembly as claimed in claim 5, wherein said inner surface layer is formed of said aromatic polyimide resin material.

8. A hook assembly as claimed in claim 5, wherein said bearing rib comprises a metal rib base having a rail end section and a loop-spreading section spaced circumferentially from said rail end section, and a coating member formed of said aromatic polyimide resin material and defining said outer surface layer, said coating member being integrally fixed to said metal rib base except for said loop spreading section thereof.

9. A hook assembly for a sewing machine, said hook assembly comprising:

a bobbin case basket having an outer circumference and a circumferentially extending bearing rib on said outer circumference, said bearing rib comprising a metal rib base having a rail end section and a loop-spreading section spaced circumferentially from said rail end section, and a coating member integrally fixed to said metal rib base except for said loop spreading section thereof;

a hook member circumferentially surrounding said bobbin case basket and rotatable relative thereto, said hook member having an inner circumference having formed therein a circumferentially extending groove shaped bearing raceway having a steel inner surface layer;

said bearing rib fitting in said bearing raceway with an outer surface layer of said bearing rib defined by said coating member confronting said inner surface layer of said raceway; and said coating member defining said outer surface layer being formed of a synthetic resin material having properties such that, upon rotation of said hook member relative to said bobbin case basket, friction between said outer surface layer and said inner surface layer, with no industrial sewing machine oil present therebetween, is less than friction that would occur with industrial sewing machine oil present therebetween.

10. A hook assembly as claimed in claim 9, wherein said synthetic resin material comprises a liquid crystal polymer.

11. A hook assembly as claimed in claim 9, wherein said synthetic resin material comprises an aromatic polyimide resin.

* * * * *